US009808726B2

(12) United States Patent
Johnson

(10) Patent No.: US 9,808,726 B2
(45) Date of Patent: Nov. 7, 2017

(54) SYSTEM AND METHOD FOR RIDER PROPULSION

(71) Applicant: Garrett Johnson, Virginia Beach, VA (US)

(72) Inventor: Garrett Johnson, Virginia Beach, VA (US)

(73) Assignee: Garrett T. Johnson, Virginia Beach, VA (US)

( * ) Notice: Subject to any disclaimer, the term of this patent is extended or adjusted under 35 U.S.C. 154(b) by 0 days.

(21) Appl. No.: 15/038,391

(22) PCT Filed: Nov. 24, 2014

(86) PCT No.: PCT/US2014/067121

§ 371 (c)(1),
(2) Date: May 20, 2016

(87) PCT Pub. No.: WO2015/077704

PCT Pub. Date: May 28, 2015

(65) Prior Publication Data

US 2016/0288001 A1 Oct. 6, 2016

Related U.S. Application Data

(60) Provisional application No. 61/907,708, filed on Nov. 22, 2013.

(51) Int. Cl.
*A63G 21/18* (2006.01)
*A63G 3/00* (2006.01)

(52) U.S. Cl.
CPC ..... *A63G 21/18* (2013.01); *A63G 3/00* (2013.01)

(58) Field of Classification Search
CPC ..... A63G 3/00; A63G 21/00; A63G 21/18; A63G 31/007; A63B 69/0093; A63B 69/125; A63B 2009/008; A63B 2208/12
USPC ..... 472/13, 117, 128, 129
See application file for complete search history.

(56) References Cited

U.S. PATENT DOCUMENTS

| | | | |
|---|---|---|---|
| 2,056,855 | A | 10/1936 | Herz |
| 3,009,273 | A | 11/1961 | Gessman |
| 3,116,695 | A | 1/1964 | Faller |
| 3,425,152 | A | 2/1969 | Foulkes |
| 3,477,723 | A | 11/1969 | Djedda |
| 3,802,697 | A | 4/1974 | Le Mehaute |

(Continued)

FOREIGN PATENT DOCUMENTS

| | | |
|---|---|---|
| FR | 2693225 | 9/1994 |
| WO | 9105170 | 4/1991 |

(Continued)

OTHER PUBLICATIONS

International Search Report responding to Application No. PCT/US2014/067121, dated Feb. 3, 2015.

*Primary Examiner* — Kien Nguyen
(74) *Attorney, Agent, or Firm* — Williams Mullen, PC; M. Bruce Harper

(57) ABSTRACT

A rider propulsion system for use with a water ride having a plurality of waterjets is disclosed. The system includes a dewatering tank configured to hold a volume of water used to support operation of the water ride, a compressed air system configured to supply pressurized air to the dewatering tank so as to pressurize the water, and at least one release valve configured to selectively release water from the dewatering tank in a controlled manner and provide it to the plurality of waterjets.

13 Claims, 6 Drawing Sheets

(56) References Cited

U.S. PATENT DOCUMENTS

| | | | |
|---|---|---|---|
| 3,834,167 | A | 9/1974 | Tabor |
| 3,880,552 | A | 4/1975 | Mason |
| 3,973,771 | A | 8/1976 | Schuman |
| 4,174,808 | A | 11/1979 | Latin |
| 4,276,664 | A | 7/1981 | Baker |
| 4,296,602 | A | 10/1981 | Hales et al. |
| 4,362,433 | A | 12/1982 | Wagner et al. |
| 4,515,500 | A | 5/1985 | Bastenhof |
| 4,522,535 | A | 6/1985 | Bastenhof |
| 4,539,719 | A | 9/1985 | Schuster |
| 4,558,474 | A | 12/1985 | Bastenhof |
| 4,690,585 | A | 9/1987 | Holmberg |
| 4,712,944 | A | 12/1987 | Rose |
| 4,720,210 | A | 1/1988 | Stoner et al. |
| 4,730,355 | A | 3/1988 | Kreinbihl |
| 4,805,896 | A | 2/1989 | Moody |
| 4,805,897 | A | 2/1989 | Dubeta |
| 4,812,077 | A | 3/1989 | Raike |
| 4,958,956 | A | 9/1990 | Tanaka et al. |
| 4,981,392 | A | 1/1991 | Taylor |
| 5,049,080 | A | 9/1991 | Kriebel et al. |
| 5,050,882 | A | 9/1991 | Yang |
| 5,098,222 | A | 3/1992 | Robinson |
| 5,186,578 | A | 2/1993 | Perslow |
| 5,207,531 | A | 5/1993 | Ross |
| 5,226,747 | A | 7/1993 | Wang et al. |
| 5,230,662 | A | 7/1993 | Langford |
| 5,279,512 | A | 1/1994 | Manale |
| 5,282,487 | A | 2/1994 | Timpany |
| 5,364,208 | A | 11/1994 | Taguchi |
| 5,370,476 | A | 12/1994 | Streichenberger |
| 5,421,782 | A | 6/1995 | Lochtefeld |
| 5,503,597 | A | 4/1996 | Lochtefeld |
| 5,507,601 | A | 4/1996 | Taguchi |
| 5,522,674 | A | 6/1996 | Cooper |
| 5,536,210 | A | 7/1996 | Barber |
| 5,544,983 | A | 8/1996 | Taguchi |
| 5,611,671 | A | 3/1997 | Tripp, Jr. |
| 5,645,373 | A | 7/1997 | Jenkins |
| 5,647,983 | A | 7/1997 | Limcaco |
| 5,688,075 | A | 11/1997 | Gradek |
| 5,720,056 | A | 2/1998 | Aymes |
| 5,738,590 | A | 4/1998 | Lochtefeld |
| 5,766,082 | A | 6/1998 | Lochtefeld |
| 5,833,393 | A | 11/1998 | Carnahan et al. |
| 5,857,910 | A | 1/1999 | Watanabe et al. |
| 6,119,955 | A | 9/2000 | Starr |
| 6,164,870 | A | 12/2000 | Baruh |
| 6,182,910 | B1 | 2/2001 | Huen |
| 6,186,701 | B1 | 2/2001 | Kempers |
| 6,210,113 | B1 | 4/2001 | Ihrenberger |
| 6,224,342 | B1 | 5/2001 | Russell et al. |
| 6,460,201 | B1 | 10/2002 | Lochtefeld |
| 6,565,283 | B1 | 5/2003 | Hall |
| 6,619,884 | B2 | 9/2003 | Davis et al. |
| 6,640,470 | B2 | 11/2003 | Chesner et al. |
| 6,715,958 | B2 | 4/2004 | Wittenberg et al. |
| 6,738,992 | B2 | 5/2004 | Lochtefeld |
| 6,857,967 | B2 | 2/2005 | Loyd et al. |
| 6,912,738 | B2 | 7/2005 | Black |
| 6,964,069 | B2 | 11/2005 | English et al. |
| 7,223,137 | B1 | 5/2007 | Sosnowski |
| 7,285,053 | B2 | 10/2007 | Henry et al. |
| 7,438,080 | B2 | 10/2008 | Johnson |
| 7,478,441 | B2 | 1/2009 | Johnson |
| 7,478,811 | B2 | 1/2009 | Johnson |
| 7,497,643 | B2 | 3/2009 | Carnahan et al. |
| 8,166,582 | B2 | 5/2012 | Johnson |
| 2001/0014256 | A1 | 8/2001 | Carnahan et al. |
| 2002/0082097 | A1 | 6/2002 | Henry et al. |
| 2004/0261858 | A1 | 12/2004 | Ferrel |
| 2005/0085306 | A1 | 4/2005 | Henry et al. |
| 2006/0022470 | A1 | 2/2006 | Johnson |
| 2006/0253969 | A1 | 11/2006 | Johnson |
| 2009/0217451 | A1 | 9/2009 | Johnson |

FOREIGN PATENT DOCUMENTS

| | | |
|---|---|---|
| WO | 02058810 | 8/2002 |
| WO | 20150077704 | 5/2015 |

SYSTEM AND METHOD FOR RIDER PROPULSION

CROSS REFERENCE TO RELATED APPLICATIONS

This application is a national stage filing under 35 U.S.C. 371 of International Application No. PCT/US2014/067121, filed Nov. 24, 2014, which claims the benefit of U.S. Provisional Application 61/907,708 filed on Nov. 22, 2013, both of which are hereby incorporated in their entirety.

STATEMENT REGARDING GOVERNMENT SUPPORT

None.

FIELD OF THE INVENTION

The present invention relates to a system and method for propelling riders or passengers within a water ride.

BACKGROUND

Some water-themed amusement rides have introduced the concept of propelling riders, objects, or passengers along conduits, chutes, or channels (used interchangeably). Some rides propel riders by creating a primary flow or stream of water within the conduit or chute. Such a stream must be strong enough to sustain the motion of a desired range of riders over a predetermined length of conduit. For example, a ride might include an initial decline, followed by a level portion leading to a second decline. In such case, the stream is maintained by the conversion of potential energy into kinetic energy, with the kinetic energy at the bottom of the first decline sufficient to propel the rider to the second decline. The rider may be directly within the stream, or floating on the stream with a pad, mat, small boat, float, or other such object.

In another example, riders may be propelled by one or more waterjets situated within a portion of the conduit or channel. The jet is oriented so as to impart momentum to the rider along a desired direction within the conduit. In this way, the primary stream may be reduced or even omitted, with the one or more propelling streams or jets moving the rider along. In this approach, the waterjets have been successfully implemented in rides that include inclines as well as level conduit and declining conduit.

As discussed in U.S. Pat. No. 5,503,597, the waterjets may be operated by using the pressure generated from a pump or an elevated reservoir. Nozzle pressure was disclosed as ranging from 5 to 250 psi, with a preferred range of 15-25 psi. While various configurations of piping have been implemented and disclosed, these conventional embodiments have largely been implemented with electric motor driven impeller pumps within the system. Some versions supply nozzles from the discharge of such pumps. Other versions include an elevated reservoir or tank, which may then be supplied by such pumps.

The input power $P_i$ required by a pump is generally a function of the energy imparted (H, potential energy, or head) to the water and the flow rate Q of the water, with the remaining inputs being constants associated with water property or pump efficiency:

$$P_i = \frac{\rho g H Q}{\eta}$$

Flow rate and energy are set by the needs of the water ride design, and the specific conduit configuration. For example, higher and longer portions of conduit would generally require more power than lower, shorter portions. Experience has shown that many of these embodiments face high energy costs for such waterjets, with one example in the year 2013 having energy cost of $150,000 to $200,000 for that single season of operation.

This high rate of energy consumption persists despite the use of motion detection sensors to time the opening of solenoid valves to release the jetted water needed for a particular rider. While the motion sensors and solenoid valves can reduce the volume of water discharged, and possibly the decrease in pressure, there is little overall reduction in energy due to operational constraints.

The approach in U.S. Pat. No. 5,503,597 requires the maintenance of water at pressure. The electric motor driven pumps are reactive loads that consume additional power and current during startup, as the rotors and pump accelerate to operational levels. Shutting pumps down between riders would increase the overall power consumed. In addition, for many embodiments the pumps must be in an operational status to be available for the next rider. Shutting the pumps down between riders would introduce potential delays, given the time needed to start up the pumps. With the increase in power consumption during start up, multiple pumps are often started sequentially to spread out power demand. Cycling the pumps may introduce additional wear, and would require additional attention from operators.

Accordingly, there is a need for a system and method with a reduced energy costs.

SUMMARY

A new, lower energy consuming approach is needed for the propulsion of riders of a water ride. It has been discovered that a compressed air system may apply a blanket of compressed air to a body of water. The pressurized air translates the pressure to the water, which may then be released in a controlled manner via nozzles to create waterjets within a channel or conduit of a water ride. Compressed air introduces aspects of control unavailable to pure water systems. For example, embodiments of the present approach may include air compressors as a source of pressurized air, and in such embodiments the air compressors may sleep or cycle with periods of low cost inactivity. The present approach may be manifested as a system, a water ride, a device, a computer implemented method, or a non-transient computer readable medium.

DETAILED DESCRIPTION

As described above, the nature of the prior approaches requires the maintenance of pumps in an operational status for pressurized water during operation of the water ride. The present approach employs air pressure to provide on-demand availability of pressurized water.

As a general matter, compressed air systems are not considered very energy efficient. In fact, operation of an electric motor driven air compressor ranks on about the same level of electrical consumption as operation of electric motor driven pumps. However, the inventor has discovered that a compressed air system may be employed with a pressurized water system to make pressurized water available on an on-demand basis for the creation of jets of water for propelling riders of a water ride.

Figure 1:
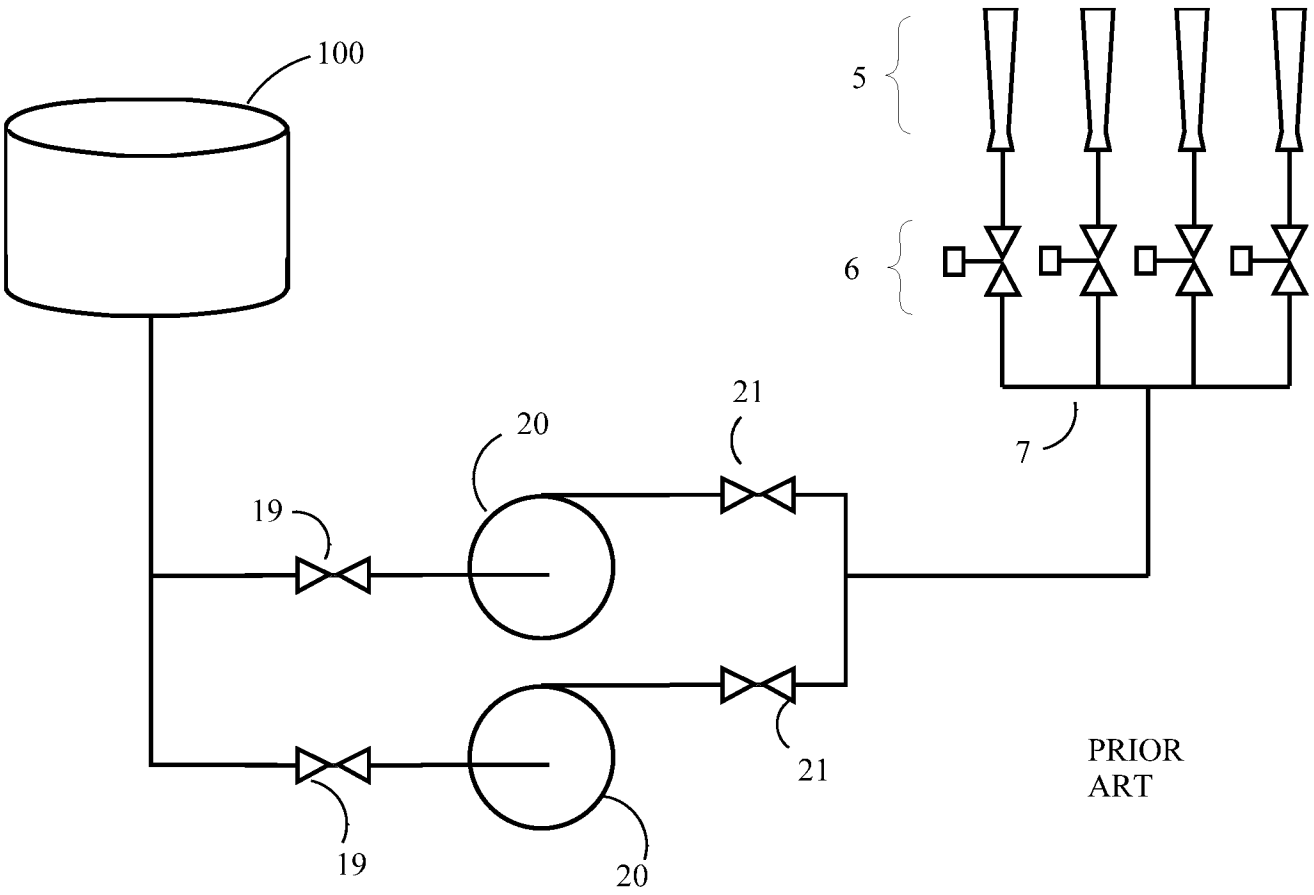
FIG. 1 is a schematic illustration of a conventional approach to rider propulsion within a water ride.

With reference to the figures, FIG. 1 is a schematic of conventional approaches. Water source 100 provides water to pumps 20 via pump inlet valves 19. Pumps 20 discharge higher pressure water through outlet valves 21, feeding into manifold 7. Nozzles 5 may be installed along the rider or passenger conduit, such that when nozzle control valve 6 is actuated to permit flow, nozzles 5 discharge a jet of pressurized water sufficient to propel the rider in a desired manner. One variation is a water tower supplying manifold 7 by gravity feed, with pumps 20 maintaining capacity within the water tower as a reservoir.

Figure 2:
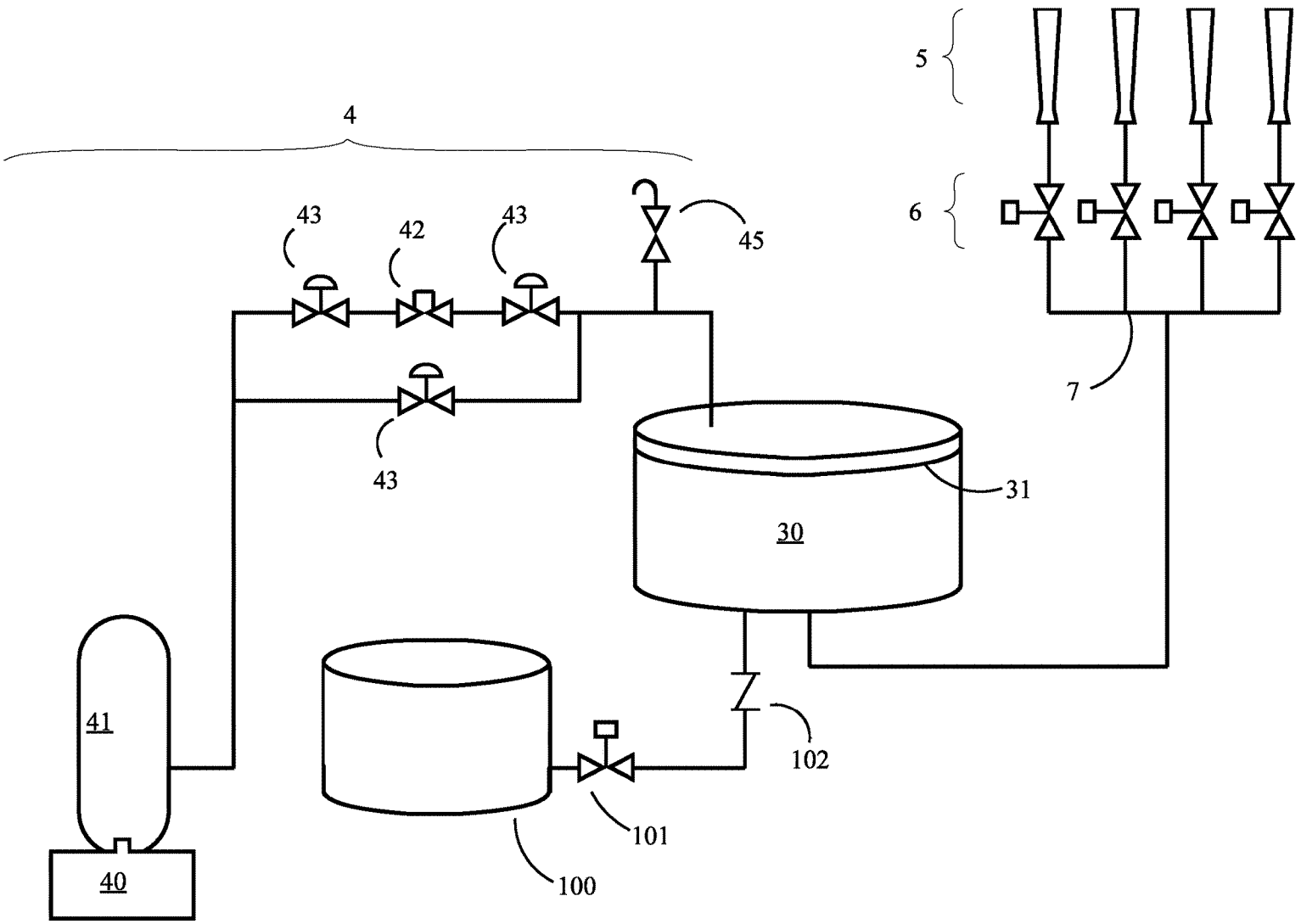
FIG. 2 is a schematic illustration of aspects of an embodiment of the present approach.

FIG. 2 is a schematic showing an aspect of an embodiment of the present approach. A compressed air system 4 is provided having one or more air compressors 40, one or more compressed air accumulators 41, one or more air cutout valves 43, and interconnecting air piping 44 placing compressed air system 4 in communication with a dewatering tank 30. While compressed air accumulator 41 may be optional for some embodiments, it may advantageously be used to dampen or stabilize compressed air parameters in periods of demand. In some embodiments, an accumulator 41 may be a tank sized to hold a desired fraction of compressor 40 output volume, in order to permit an efficient or desired operating pattern for compressor 40 relative to the demand of the water ride. For example, accumulator 41 may thus decrease unloaded power consumption, and increase periods of automatic shutoff, as described below. Optionally, compressed air system 4 may include a dryer (not shown) for the removal of moisture. Dewatering tank 30 may be disposed above or below ground.

As shown, air system 4 may include a pressure regulator 42 as a diaphragm valve, or integrated with air compressor 40. The regulated air may thus be applied to any water volume in dewatering tank 30.

Because dewatering tank 30 water level will lower by the volume of water released with each actuation of nozzles 5, it may be resupplied by water source 100, shown in this embodiment with water make up valve 101 and check valve 102. Make up or re-supply of water may be in conjunction with the isolation of the pressurized air supply and venting of the compressed air applied to dewatering tank 30, shown here via vent valve 45. The make up of water to dewatering tank 30 may be controlled as a function of one or more of the rate of use of nozzles 5 (i.e., the volumetric flow consumed), volume of dewatering tank 30, the water level change in dewatering tank 30, etc. It is contemplated that supply of compressed air to dewatering tank 30 may be shut off automatically during such venting and make up. The dewatering tank 30 may contain one or more sensors used to monitor the tank's water level. The one or more water level sensors may be used to keep the tank's water level within a desired operational range. It is contemplated that the system may prevent discharge of the dewatering tank 30 when the water level sensors indicate that the tank's watering level is below a threshold level.

Dewatering tank 30 may be a tank sized to hold a desired volume of water to support operation of the water ride (not shown). It is contemplated that a water ride may include one or multiple water distribution systems for delivering water to nozzles 5 disposed at various locations of a water ride, or even to various water rides within a facility. In addition, dewatering tank 30 may be sized and configured to present a desired water surface area to the pressurized air:

$$F=PA$$

where F is the applied force, P is the pressure, and A is the area. In vertical cylinder dewatering tank 30, a circular cross section is presented so that the area A is simply $A=\pi r^2$ with r being the radius of the cross section. At a maintained or regulated pressure, an increase in the area would increase the effective force available for work, taking into consideration the effective increase in pneumatic load.

While a single air system 4 may support multiple water distribution systems, it is also contemplated that multiple air systems 4 may be advantageous for certain water ride designs. Further, it is also contemplated that air compressor 40 might be replaced with an air blower or other air pump, so long as the output reaches design pressure needed for application to any water in dewatering tank 30 to achieve acceptable performance at nozzles 5.

In operation, air compressor 40 may be used to build a desired air pressure within air system 4 and optional accumulator 41. Dewatering tank 30 may be filled with a desired volume of water. A control signal of "ON", as discussed further below, may signal an operational need for water jets from the one or more nozzles 5. In response, one or more air cutout valves 43 may open, applying an air pressure to dewatering tank 30. Of course, there may be embodiments or operational periods in which it is desirable to maintain pressurized air applied to the water in dewatering tank 30. Also in response to such a signal, nozzle control valves 6 may open and pressurized water may then be released from dewatering tank 30 via header 7 and out nozzles 5 as a jet of water. A control signal of "OFF" may trigger closing of air cutout valves 43 and nozzle control valves 6. At this point, the air applied to dewatering tank 30 may be vented by vent valve 45, and dewatering tank 30 may receive make up water from water source 100, as needed. Compressor 40 may operate only to maintain a desired range of air pressure within air system 4; compressor 40 would not necessarily be needed to operate for isolated need for operation of nozzles 5, and could sleep or shut down. Vent valve 45 may simply vent the air applied to dewatering tank 30 to the atmosphere. Alternatively, the vented air may be recycled and used to power one or more additional water park features such as, e.g., another water ride, a water gun, whistle, fountain, or wave generator.

In testing, a retrofit embodiment for an existing wave ride achieved acceptable operation with an air pressure of about 20-45 psi, with optimal results in the upper 30 psi range, such as 36-38 psi. Of course, design variation and operational needs may affect the actual air pressure needed; a desired speed of propulsion for an average rider is one example of an operational variable.

For the present approach, nozzle control valves 6 may be electric solenoid valves, for example. Alternatively, nozzle control valves 6 may be control air or hydraulically operated valves. In the interested of safety and conservation of energy/water, it is contemplated that nozzle control valves 6 may fail or default to a closed position, optionally by spring or diaphragm balance. Similarly, air cutout valves 43 might also be solenoid or similar valves to shut off unneeded air (e.g., during low demand periods, or periods of make up for dewatering tank 30), and may fail or default to a closed position.

Optionally, dewatering tank 30 may be in the form of a cylinder having a movable piston, membrane, or divider 31 disposed therein and at the interface separating pressurized air from the water. Notably, however, successful results have been achieved by direct application of pressurized air to water within dewatering tank 30.

It is contemplated that embodiments of the present system may include triggering for the release of jets of water that is controlled automatically by sensors. For example, proximity sensors may detect motion or other aspect of the presence of a rider, and may signal the system to operate for that rider. Many configurations are possible. For example, in one configuration, motion sensors may detect the approach of a rider, as well as the exiting of that rider from a chute or conduit area of interest. In another embodiment, an entry sensor may trigger a timer conservatively set up to execute a period of operation appropriate for moving any expected rider. The system may be shut down in the absence of need. In this way, the system is responsive to the demand for operation created by such rider. It is contemplated that such a sensor triggered system may include an override for testing or for periods of heavy demand.

Embodiments of sensors and valve actuators are contemplated as inter-relating via a computer network. In this manner, the maintenance of air pressure in accumulator 41 and water in dewatering tank 30 may be optimized for a desired ride experience, power consumption, and water consumption. Such an embodiment, for example, may avoid the mechanical maintenance of unnecessary air pressure; an air compressor may be sufficiently responsive so as to be able to charge accumulator 41 to operational levels in the time it takes for a rider to reach the chute or conduit of concern. Further, the choice of air compressor 40 may be optimized to the operational specifications for a particular ride and embodiment of the concept. A compressed air system 4 serving multiple water rides may require a performance standard different from an embodiment dedicated to a single ride. A single set of compressors 40 may be able to supply multiple water rides, but optimal requirements for such an embodiment may differ from the dedicated embodiment.

The above optimization methods may be implemented within a non-transitory computer readable medium storing a computer program, operable on a configured computer processor to perform the steps of the above methods. A particularly configured computer system that includes suitable programming means for operating in accordance with the disclosed methods falls well within the scope of the present invention. Suitable programming means include any means for specifically configuring and directing a computer system to execute the steps of the system and method of the invention, including for example, systems comprised of processing units and arithmetic-logic circuits coupled to computer memory, which systems have the capability of storing in non-transitory computer memory, which non-transitory computer memory includes electronic circuits configured to store data and program instructions, with programmed steps of the method of the invention for execution by a processing unit. Aspects of the present invention may be embodied in a computer program product, such as a diskette or other non-transitory recording medium, for use with any suitable data processing system. The present invention can further run on a variety of operating system platforms. Appropriate hardware, software and programming for carrying out computer instructions between the different elements and components of the present invention may be provided.

Figure 3:
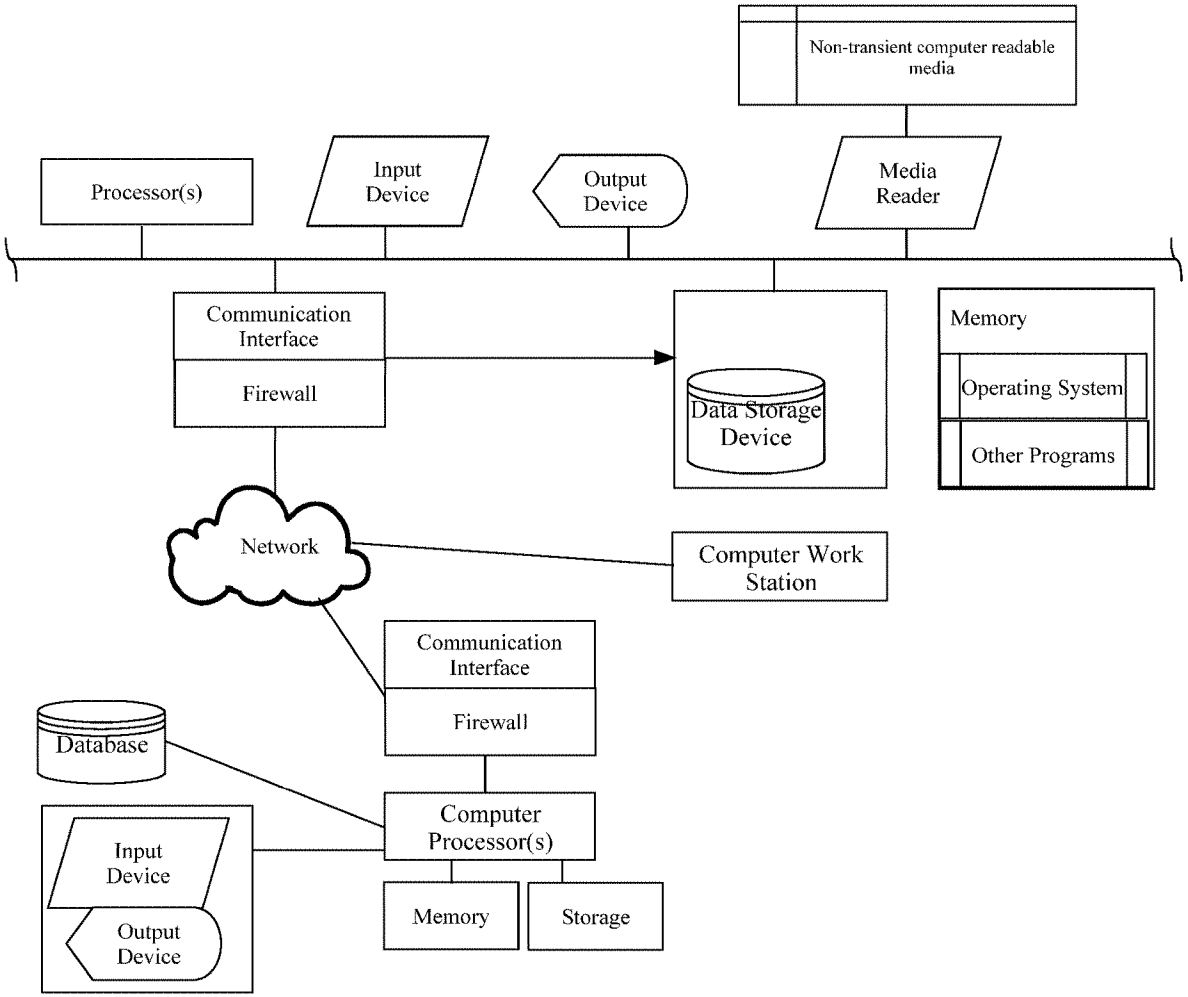
FIG. 3 is a schematic illustration of aspects of an embodiment of the present approach.

For example, in reference to FIG. 3, a rider sensor disposed at a desired location within the water ride may be configured as an Input Device; the Input Device may trigger a call to programming routines appropriate to the desired response of the propulsion system. Output Device might be a control signal generator, triggering an "ON" or valve actuation signal to actuate nozzle control valves 6. At a predetermined condition or time, as may be determined by such programming subroutine, the Output Device might generate a signal triggering an "OFF" signal to nozzle control valves 6. In one embodiment, air compressor 40 may simply operate when needed to maintain air pressure in accumulator 41 within a particular band.

Output Device may be used also to maintain the desired parameters within air system 4. For example, Input Device may receive a pressure signal from a pressure sensor located within or disposed at a desired point of air system 4. Input Device may relay this signal to programming subroutine for On/Off Control of compressor 40. In such cybernetic systems, there is typically a low pressure activation point and a high pressure deactivation point. The programming subroutine may prevent short cycling, for example, if compressor 40 were a reciprocating compressor. In this manner, compressor 40 may be deactivated in low demand periods.

In some embodiments, it may be desirable for compressor 40 to include a variable speed capability, as may be found with some rotary screw compressors. In this case, Output Device may include the generation of a speed signal to maintain operation of variable speed compressor 40 to optimize energy efficiency.

Embodiments of the present approach are thus able to save expense by reduced power consumption, save in reduced water consumption, and reduce the expense and complication of generating pressurized water by electric motor driven pumps. An on-demand system uses only a controlled portion of water for each rider, metered for the need of the chute or conduit. In other words, the water and period of operation may be tailored to the water ride portion, whether level, incline, decline, straight or turning. Embodiments may also vary the level of acceleration to the need of the ride. It is contemplated that embodiments of the present approach be able to operate at an expense of about a tenth of the prior conventional approaches.

The use of compressed air system 4 also means that less structure is needed to generate high pressure water with pumps. The infrastructure of compressed air system 4 is expected to save installation expense over conventional embodiments. In addition, because compressed air may be distributed about a facility at an installation expense less than a high pressure water system, further savings may also be available.

An important benefit for the operation of the ride is that an on-demand system permits allocation of cost to a per rider basis. The operator may track consumption of water and power, and adjust rider cost accordingly.

Figure 4A:
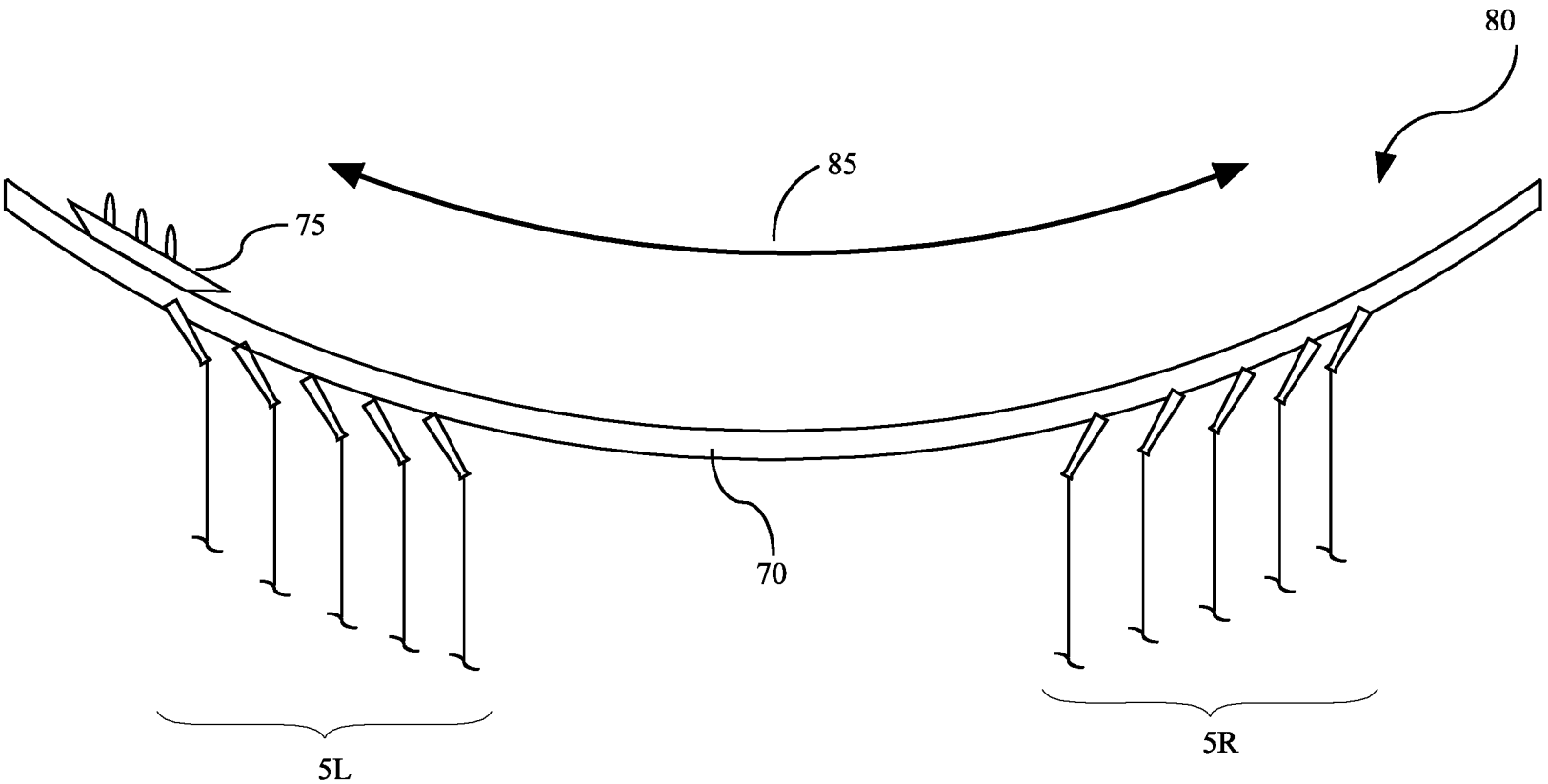
FIGS. 4A, 4B, and 4C illustrate aspects of an embodiment of a water ride enabled by the present approach.

A further benefit of the present approach for operation of water rides is that it enables increasingly complex rides. Historically, power and water constraints have limited the implementation or use of waterjets in a chute or channel to the minimum reasonably necessary; this has conventionally been to convey the rider to a point where the rider could release further potential energy, such as the start of a gravity slide, for example. As noted above, however, the on-demand system consumes less power and water. Because of this, some water ride designs may be implemented that otherwise would be cost prohibitive. FIG. 4A illustrates one example, which may be water ride 80 in a half pipe configuration. A curved chute or conduit 70 may include a rider or multi-rider boat 75; the actual configuration of conduit 70 may vary, so long as the ride permits a reciprocating effect illustrated by arrow 85. Proximity or photo sensors (not shown) in conduit 70 may trigger the discharge of nozzles 5L to propel boat 75 to a point of high potential energy, as shown. The sensors may release or shut off the discharge of waterjets from nozzles 5L and the boat 75 would then begin to translate its potential energy to kinetic energy as it moved from left to right along conduit 70. At a desired point, sensors (not shown) would trigger nozzles 5R to discharge to drive boat 75 to a second elevated portion, and so on. In this manner, the reciprocating effect shown by arrow 85 might be achieved.

Figure 4B:
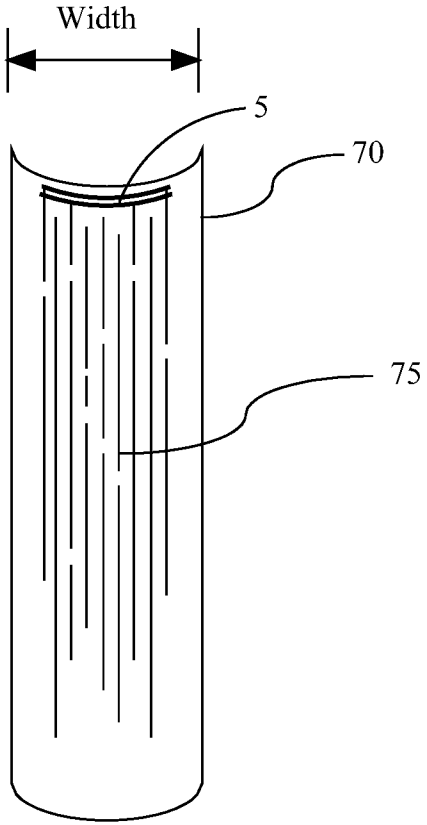

FIG. 4B is an example of a portion of a channel or conduit 70 cut away, with one or more recessed nozzles 5 discharging water 75 along the conduit 70. Exemplary widths of some conduit 70 may be 3-4 feet; actual width will vary with the desired effect for the ride 80. Optionally, conduit 70 may include water return channels (not shown) or other features for water management. Nozzles 5 can be disposed at any appropriate location of the channel 70, including the sides, bottom, or rear of the channel 70.

Figure 4C:
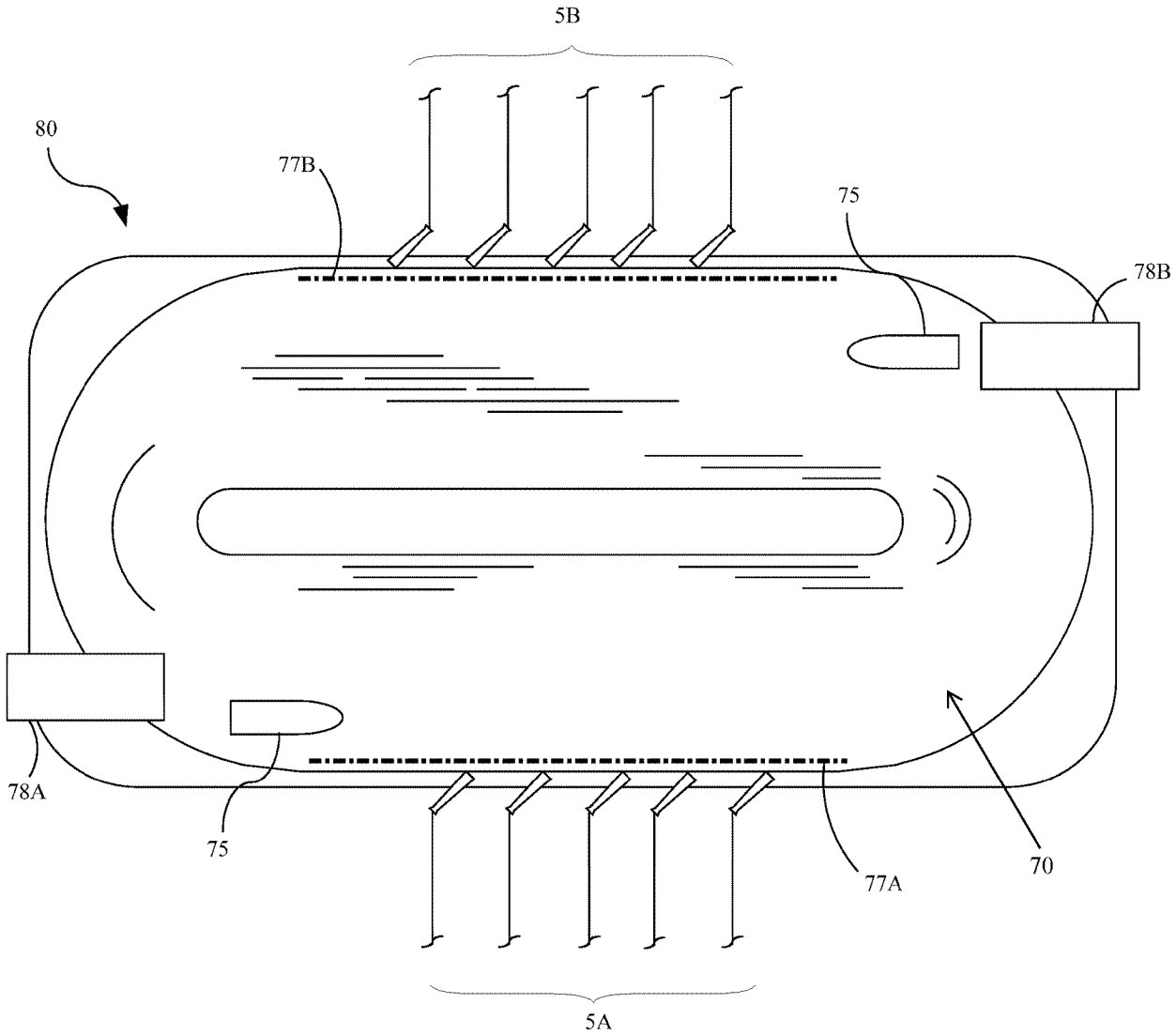

FIG. 4C is another example of a water ride 80 that may have been cost prohibitive prior to the present approach. A large scale format may be embodied for hosting multi-passenger boats 75. Optionally, base current generators 78A and B may be used to impart a base line current flow within wave ride 80. Current generators 78A and B may be pumps, paddles, wave cannons, etc. Curved chute or conduit 70 is shown in a simple oval flow pattern, but may vary as desired, including embodiments with more complicated flow patterns; a continuous flow may be desirable for some embodiments. Proximity or photo sensors 77A and 77B are shown in an array format, associated with sets or arrays of nozzles 5A and 5B. Individual sensors within sensors 77A may be aligned with individual nozzles of nozzles 5A, such that nozzles 5A may be triggered sequentially. Nozzles 5A and 5B may be disposed or situated within a bottom or side wall forming conduit 70, with a discharge or waterjet direction selected to propel riders in boat 75 in a desired direction, as shown. Thus, a sensor within sensors 77A may trigger the discharge of a nozzle within nozzles 5A to propel boat 75 along conduit 70. The sensors may release or shut off the discharge of waterjets when boat 75 has passed. The configuration of water ride 80 along with the on-demand performance of nozzles means that boats 75 may be controlled and separated, with coordination in firing of nozzles 5B and 5A responsive to changes in the separation distance. In this manner, boats 75 might be maintained at a safe separation, or simply a level of separation designed to enhance water ride enjoyment.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

What is claimed is:

1. A rider propulsion system for use with a water ride having a plurality of waterjets oriented so as to impart momentum in a desired direction to a rider of the water ride, the rider propulsion system comprising:

a dewatering tank sized to hold a desired volume of water used to support operation of the water ride;

a compressed air system configured to supply pressurized air to the dewatering tank so as to pressurize the desired volume of water;

at least one control valve configured to selectively release pressurized water from said dewatering tank in a controlled manner and provide it to at least one of said plurality of waterjets;

a computerized control system configured to control both the compressed air system's delivery of pressurized air to the dewatering tank and operation of the at least one control valve; and wherein said rider propulsion system comprises at least one ride sensor configured to be disposed on the water ride so as to detect the presence of the rider, the computerized control system being configured to control the operation of the at least one control valve based at least in part on information supplied by the at least one ride sensor.

2. The rider propulsion system of claim 1, wherein each of said plurality of waterjets comprises a nozzle.

3. The rider propulsion system of claim 1, wherein said dewatering tank comprises a tank having a movable divider disposed therein at an interface separating said pressurized air from said pressurized water.

4. The rider propulsion system of claim 1, wherein said compressed air system comprises an air compressor, an air accumulator, at least one air cutout valve, and interconnecting air piping placing said compressed air system in communication with said dewatering tank.

5. The rider propulsion system of claim 1, further comprising a water resupply system configured to resupply the dewatering tank, the water resupply system comprising a water source, a make up valve, and a check valve.

6. The rider propulsion system of claim 1, further comprising a vent valve capable of being opened to vent said pressurized air from the dewatering tank.

7. The rider propulsion system of claim 1, wherein said compressed air system comprises a pressure regulator.

8. The rider propulsion system of claim 1, further comprising at least one sensor configured to monitor a water level of the dewatering tank.

9. A water ride system comprising:

a water ride comprising a conduit and a plurality of water nozzles configured to direct water so as to impart momentum to a rider along a desired direction within the conduit;

a dewatering tank sized to hold a desired volume of water used to support operation of the water ride;

a water resupply system configured to resupply the dewatering tank, the water resupply system comprising a water source and a make up valve, wherein the make up valve is configured to selectively release water from the water source and provide it to the dewatering tank;

a compressed air system configured to supply pressurized air to the dewatering tank so as to pressurize the desired volume of water, wherein the compressed air system comprises an air compressor and an air supply valve configured to selectively provide pressurized air from the air compressor to the dewatering tank;

at least one control valve configured to selectively release pressurized water from the dewatering tank in a controlled manner and provide it to at least one of said plurality of water nozzles a vent valve that can be opened to vent said pressurized air from the dewatering tank, a computerized control system configured to control operation of said at least one control valve, said make up valve, said vent valve, and said air supply valve; and wherein said water ride comprises at least one ride sensor configured to detect the presence of the rider, the computerized control system being configured to control the operation of the at least one control valve based at least in part on information supplied by the at least one ride sensor.

10. The water ride system of Claim 9, wherein the compressed air system further comprises an air accumulator configured to stabilize compressed air parameters during periods of demand.

11. The water ride system of claim 9, wherein said computerized control system is configured to control said operation of said make up valve based at least in part on information provided by a water level sensor, said water level sensor being configured to monitor a water level of said dewatering tank.

12. The water ride system of claim 9, wherein said computerized control is configured to automatically shut off the supply of pressurized air to the dewatering tank during venting and make up.

13. The water ride system of claim 9, wherein said water ride comprises a water slide.

* * * * *